US006668899B1

(12) United States Patent
Thomas, Jr.

(10) Patent No.: US 6,668,899 B1
(45) Date of Patent: Dec. 30, 2003

(54) LATERALLY MOVING SUPPORTS FOR HORIZONTAL BLINDS

(76) Inventor: Thomas A. Thomas, Jr., 10295 NW. 46 St., Sunrise, FL (US) 33351

( * ) Notice: Subject to any disclaimer, the term of this patent is extended or adjusted under 35 U.S.C. 154(b) by 54 days.

(21) Appl. No.: 10/054,000

(22) Filed: Jan. 24, 2002

Related U.S. Application Data

(60) Provisional application No. 60/311,949, filed on Aug. 13, 2001.

(51) Int. Cl.[7] ..... E06B 9/26

(52) U.S. Cl. ..... 160/167 R; 160/115

(58) Field of Search ..... 160/167 R, 194, 160/199, 206, 902, 107, 115, 34, 61

(56) References Cited

U.S. PATENT DOCUMENTS

| | | | | | |
|---|---|---|---|---|---|
| 534,523 | A | * | 2/1895 | Schmitt | 160/61 |
| 564,413 | A | * | 7/1896 | Stilwell | 160/61 X |
| 1,625,021 | A | * | 4/1927 | Dodge | 160/167 R |
| 2,136,012 | A | * | 11/1938 | Jones | 160/61 X |
| 2,213,021 | A | * | 8/1940 | Solon | 160/167 R |
| 2,492,867 | A | * | 12/1949 | Johnson | 160/167 R |
| 2,796,926 | A | * | 6/1957 | Klenz | 160/167 R |
| 2,799,333 | A | * | 7/1957 | Baroni | 160/115 X |
| 2,802,523 | A | * | 8/1957 | Anderle | 160/167 R |
| 4,177,853 | A | | 12/1979 | Anderson | |
| 4,346,931 | A | | 8/1982 | Merkle | |
| 4,580,753 | A | | 4/1986 | Hennequin | |
| 5,524,390 | A | * | 6/1996 | Christensen | 160/104 X |

* cited by examiner

*Primary Examiner*—David Purol
(74) *Attorney, Agent, or Firm*—Alvin S. Blum

(57) ABSTRACT

A support system is provided for mounting on a wall at an opening for a window or glass door. The support system is designed to support horizontal blinds or shades with the brackets that are ordinarily used to mount the blinds directly to a wall. The support system has control mechanism to move the blind or blinds laterally away from the window or door to allow access to the window or door. This is easier than raising the blind high enough to allow access. The support slides laterally behind another shade. In another embodiment the support is hinged in the middle and folds together like a bi-fold door to open.

5 Claims, 3 Drawing Sheets

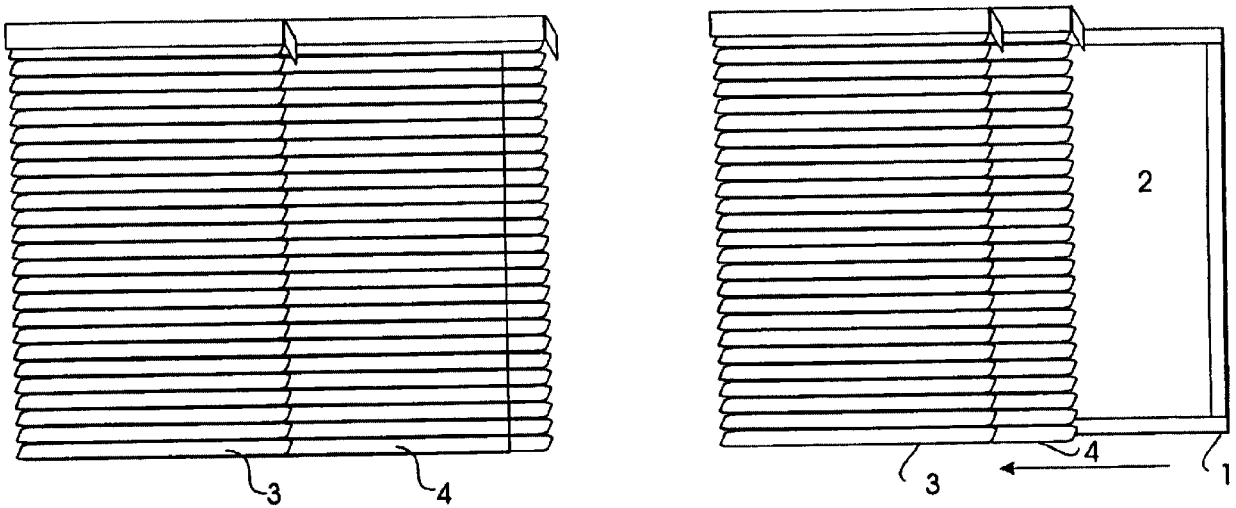
FIG. 1
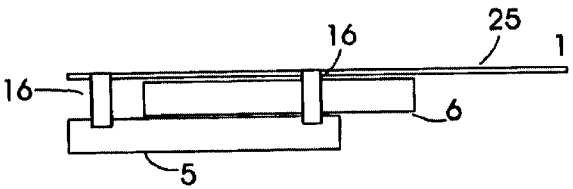
FIG. 2
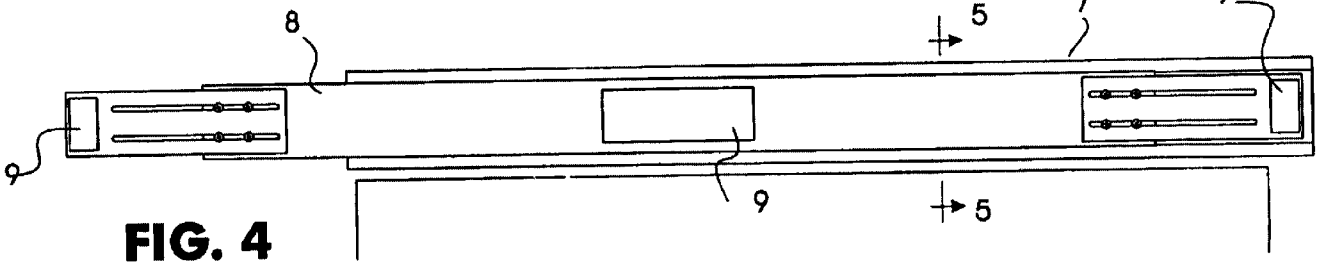
FIG. 3
FIG. 4

LATERALLY MOVING SUPPORTS FOR HORIZONTAL BLINDS

This application claims the benefit of provisional patent application Ser. No. 60/311,949 filed Aug. 13, 2001, incorporated herein by reference.

BACKGROUND OF THE INVENTION

This invention relates to supports for coverings of glass doors and windows, and more particularly to supports for horizontal blinds and shades that enable the user to move the blind laterally to enable full access to the window or door without raising the blinds.

There are two types of blinds for covering windows and glass doors, vertical blinds and horizontal blinds. Blinds are made up of a plurality of vanes that rotate about parallel axes. When rotated in a first direction, they overlap to close off the light. When rotated in a second direction they open to admit light. An opening control pulls all of the axes together, exposing some or all of the door or window. All of the axes of vertical blinds are disposed vertically. The opening control can pull all of the vanes laterally to one side of the door or window to enable full access for egress, ingress, or cleaning. All of the axes of the vanes of horizontal blinds are disposed horizontally. The opening control raises the vanes. There are shades of different types that also open by lifting the bottom edge upward, which will herein also be termed horizontal blinds. Sliding glass doors are commonly eighty to ninety inches tall. To raise the horizontal blinds this high is difficult. Consequently, vertical blinds are favored for this application. However, horizontal blinds have many advantages, and are increasing in popularity. The window operator may be more readily accessed with horizontal blinds. It is awkward to have vertical blinds for the doors and horizontal blinds for the windows. It would be useful to have a means for moving a horizontal blind laterally to provide access to the door without raising the blinds.

SUMMARY OF THE INVENTION

It is accordingly an object of the invention to provide a system for mounting conventional horizontal blinds that would enable them to be readily moved laterally to enable full access to the window or door. The term horizontal blinds as used herein is meant to refer to obscuring covers for glazed openings such as glass windows and doors, in which the covers open by raising from the bottom. It is another object that the mounting system not interfere with the normal operation of the blind. It is yet another object that the system be readily adapted to the mounting of horizontal blinds of diverse manufacture. It is yet another object that the mounting system be readily installed by means well known in the art.

The system of the invention comprises planar surfaces to which the blinds are mounted with their usual wall mounting hardware. The support system of the invention comprises a sliding embodiment in which the blind on its planar surface slides laterally to enable access to the glass window or door opening.

An alternative embodiment of the invention comprises a system in which side by side blinds are mounted on hinged planar surfaces with a control that causes the two blinds to fold together and to one side like a bi-fold closet door.

These and other objects, features, and advantages of the invention will become more apparent when the detailed description is studied in conjunction with the drawings in which like elements are designated by like reference characters in the various drawing figures.

BRIEF DESCRIPTION OF THE DRAWINGS

FIG. 1 is a front elevation view of a pair of horizontal blinds mounted on a sliding support of the invention.

FIG. 2 is a view as in FIG. 1 with one of the blinds being moved laterally.

FIG. 3 is a top view of the assembly of FIG. 2.

FIG. 4 is a front elevation view of a support of the invention.

DETAILED DESCRIPTION OF PREFERRED EMBODIMENTS

Figure 5A:
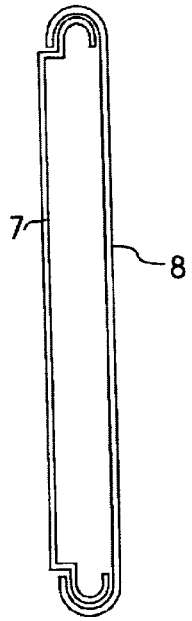
FIG. 5A is a sectional view through line 5—5 of FIG. 4.
Figure 5B:
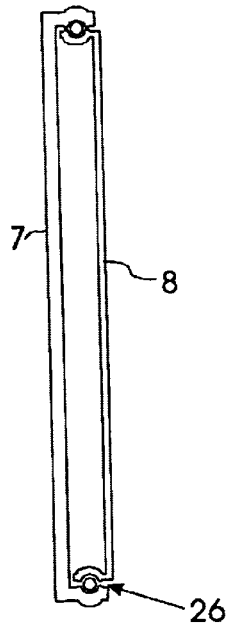
FIG. 5B is a sectional view of another embodiment through line 5—5 of FIG. 4.
Figure 5C:
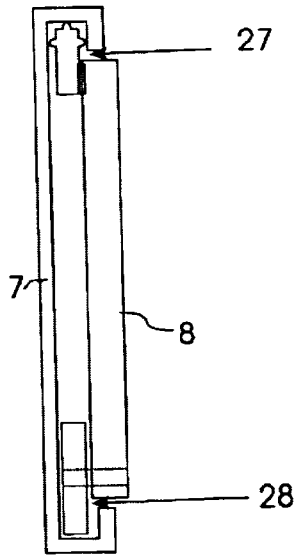
FIG. 5C is a sectional view of another embodiment through line 5—5 of FIG. 4.
Figure 5D:
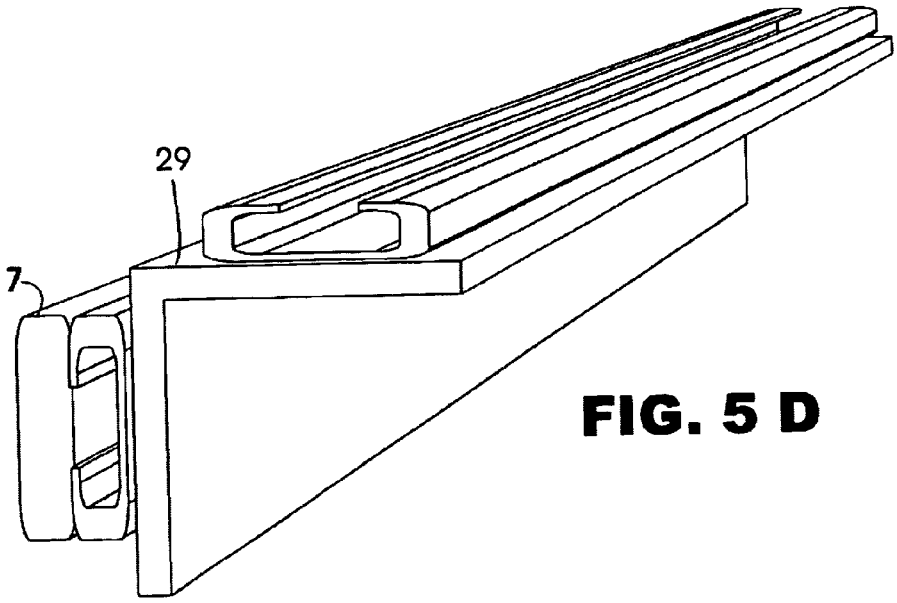
FIG. 5D is a perspective view of another embodiment through line 5—5 of FIG. 4.

Referring now first to FIGS. 1–6, a wall 1 of a building has an opening that is covered by a glazed window or door 2. Most commonly, this invention will be used to cover a sliding glass door with a horizontal blind or blinds. In order to access the door, this invention enables the user to slide the blind laterally out of the opening. The alternative of the prior art was to raise the horizontal blind high enough to permit access. This is awkward. The support system 25 of the invention is arranged to fasten to the wall 1, and to provide adjustable inserts 9 on each elongate planar surface 5,6 for the many standard mounting brackets to mount the blinds 3,4 to the support system. The blind may then be moved laterally with ease by a wand 15 or cords 14 and pulleys 13 that operate in a manner similar to draw drapery systems. A track 7 is fastened to the wall. A carrier 8 slides within the track. It may be provided with balls 26, nylon slide bearings 27 or rollers 28 to reduce sliding friction as the carrier is slid one way or the other. First planar surface 5 is mounted away from the wall 1 by extending holders 16 to enable the second planar surface to slide behind it when the blind 4 is moved laterally in a first mode of operation to open access to the sliding door 2. In a second mode of operation, the blind 4 slides laterally from behind blind 3 to cover the opening. As shown in 5*d*, the carrier 29 may take the form of an angle for use with an overhead track.

Figures 6, 7, 8:
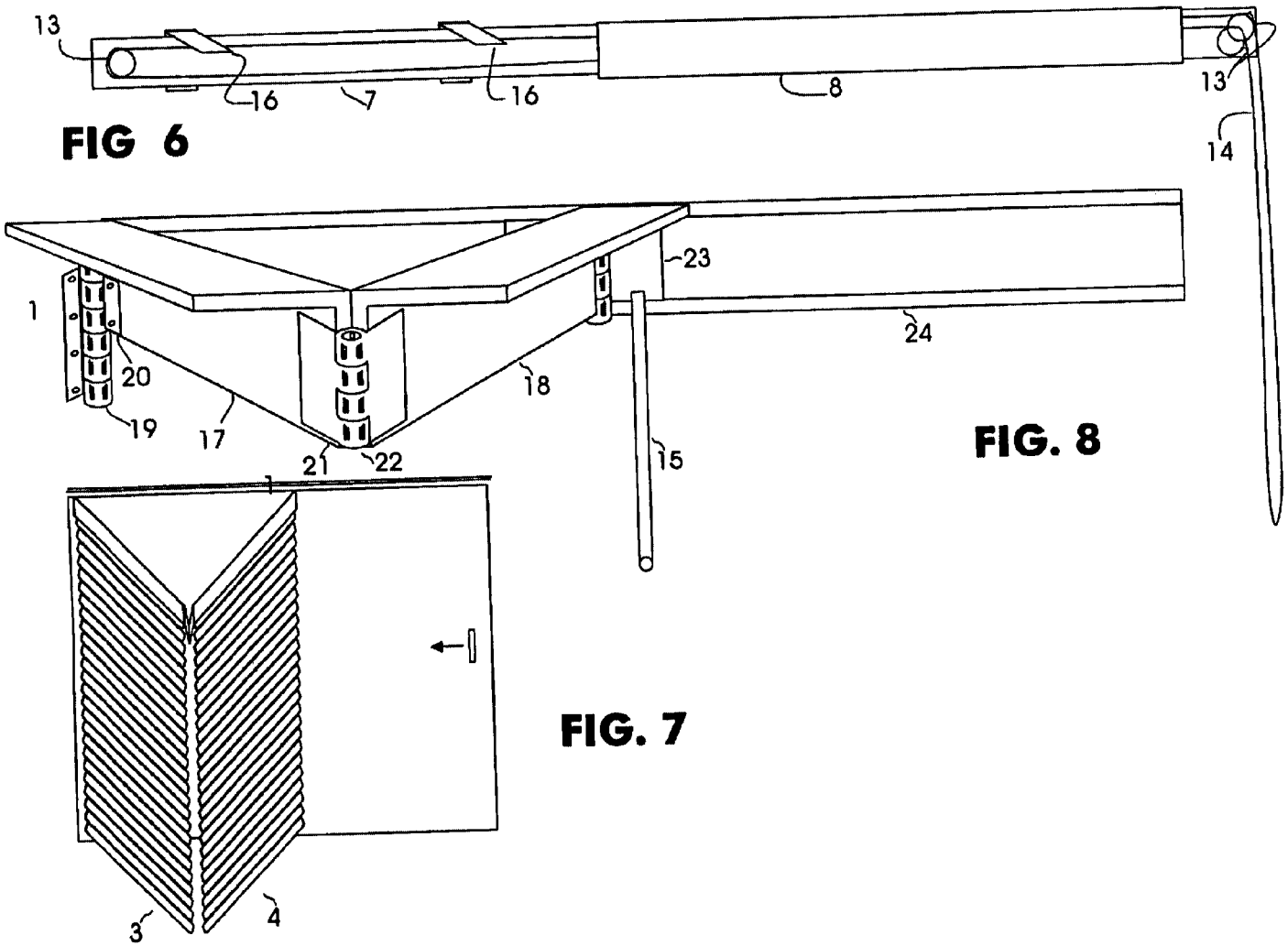
FIG. 6 is a front elevation view of another support of the invention.
FIG. 7 is a perspective view of a pair of blinds mounted on a bi-fold embodiment support of the invention.
FIG. 8 is a perspective view of the support of FIG. 7.

FIG. 6 shows a support system in which there is only one blind covering the opening and no blind beside it. Extensions 16 support a cover (not shown) to cover the track.

Referring now to FIGS. 7 and 8, an embodiment for lateral movement of the blinds that opens them by a hinging, bi-fold action is useful when the assembly is within the wall opening, for example. A first hinge 19 hingedly attaches a first end 20 of a first elongate planar surface 17 to the wall 1. A second hinge 22 hingedly connects a second end 21 of surface 17 to one end of a second planar surface 18. The other end of surface 18 is hingedly connected to carrier 23 that slides in track 24. Horizontal blinds 3, and 4 are attached to the surfaces 17 and 18 as described above. Wand 15 is used to move the carrier laterally in the track to a first, or open, mode in which the carrier is moved to the hinge 19 to thereby fold the two planar surfaces together, and out of the opening. In a second, or closed mode, the carrier is moved all the way away from hinge 19 so that the blinds will be coplanar and the opening is covered. This embodiment allows for an opening that is two blinds wide. As shown, the planar surfaces 17 and 18 may be part of angle members to provide greater rigidity.

The above disclosed invention has a number of particular features which should preferably be employed in combination, although each is useful separately without departure from the scope of the invention. While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A support system for attaching to a wall for mounting at least one horizontal blind at a wall opening closed by a glazed window or door in a building, the blind having wall mounting hardware, the support system comprising:

a) at least one elongate planar surface for attaching the horizontal blind by said wall mounting hardware thereto; and b) control means operatively connected to said at least one planar surface for moving said at least one planar surface and at least one horizontal blind attached thereto laterally in translatory motion to provide access to said wall opening in an open, first mode of operation, and to cover said wall opening in a closed, second mode of operation.

2. The support system according to claim 1 in which said at least one at least one horizontal blind comprises two horizontal blinds and in which said at least one planar surface comprises two planar surfaces to each of which a horizontal blind is attachable, the system further comprising:

a) said control means for supporting a first of the planar surfaces away from the wall, and moving a second of the planar surfaces laterally in translatory motion behind the first planar surface in the first mode of operation; and b) for moving said second of the planar surfaces laterally in translatory motion to cover the opening in the second mode of operation.

3. The support system according to claim 1 in which said at least one at least one horizontal blind comprises two horizontal blinds and in which said at least one planar surface comprises two planar surfaces, a first surface and a second surface, to each of which a horizontal blind is attachable, the system further comprising:

a) first hinge means for hingedly joining a first end of the first surface to the wall;

b) second hinge means for hingedly joining a second end of the first surface to a first end of the second surface; and c) said control means operatively connected to a second end of the second surface for laterally moving in translatory motion said second end of said second surface toward said first end of said first surface to thereby fold the two surfaces together in the first mode of operation, and for moving in translatory motion said second end of said second surface away from said first end of said first surface to cover the opening in the second mode of operation.

4. A support system for attaching to a wall for mounting at least two horizontal blinds at a wall opening closed by a glazed window or door in a building, the blinds having wall mounting hardware, the support system comprising:

a) two elongate planar surfaces to each of which a horizontal blind is attachable;

b) control means for supporting a first of the planar surfaces away from the wall, and moving a second of the planar surfaces laterally and behind the first planar surface in a first mode of operation to provide access to the opening; and c) control means for first moving said second of the planar surfaces laterally in a second mode of operation to thereby cover the opening.

5. A support system for attaching to a wall for mounting at least two horizontal blinds at a wall opening closed by a glazed window or door in a building, the blinds having wall mounting hardware, the support system comprising:

a) two elongate planar surfaces to each of which a horizontal blind is attachable;

b) first hinge means for hingedly joining a first end of the first surface to the wall;

c) second hinge means for hingedly joining a second end of the first surface to a first end of the second surface; and d) control means operatively connected to a second end of the second surface for laterally moving said second end of said second surface toward said first end of said first surface in translatory motion to thereby fold the two surfaces together in a first mode of operation to provide access to the opening, and for moving said second end of said second surface away from said first end of said first surface in translatory motion to cover the opening in a second mode of operation.

* * * * *